United States Patent [19]

Wilcox

[11] 4,014,550

[45] Mar. 29, 1977

[54] ELECTRONIC ODD BALL GAME

[76] Inventor: Orvin Wilcox, Box 3, Kapuskasing, Canada

[22] Filed: Nov. 20, 1975

[21] Appl. No.: 633,627

[52] U.S. Cl. ..... 273/153 R; 273/1 E; 273/138 A

[51] Int. Cl.² ..... A63F 9/06

[58] Field of Search ..... 273/153 R, 1 E, 138 A

[56] References Cited

UNITED STATES PATENTS

| | | | |
|---|---|---|---|
| 2,665,340 | 1/1954 | Hammerstrand | 273/153 R X |
| 3,424,455 | 1/1969 | Dunson | 273/153 R X |
| 3,690,665 | 9/1972 | Becker | 273/1 E X |
| 3,825,255 | 7/1974 | Kennard et al. | 273/1 E |

FOREIGN PATENTS OR APPLICATIONS

| | | | |
|---|---|---|---|
| 431,623 | 9/1911 | France | 273/153 R |

*Primary Examiner*—Anton O. Oechsle
*Attorney, Agent, or Firm*—Jack D. Slobod

[57] ABSTRACT

An electronic game for finding which one of 12 signals is different than the other signals and whether it is larger or smaller in magnitude includes 12 single pole double throw center-off toggle switches. A circular shift register is initialized with a digital one state in only one cell and clocked for a random period of time while an INITIALIZE button is depressed. Each cell of the shift register feeds a different one of the switch wipers. First and second contacts of the switches are respectively fed to different OR gates which in turn feed a random inverting means whose outputs feed drive a meter for comparing the sums of signals on the first and second contacts.

4 Claims, 2 Drawing Figures

ELECTRONIC ODD BALL GAME

FIELD OF THE INVENTION

The present invention relates generally to electronic games including random generators. In its particular aspects the present invention relates to a game in which a random generator provides a first signal on one of a plurality of single pole double throw switch wipers and a second signal on each of the other switch wipers and in which the switch wipers are connected for selectively coupling these signals to different terminals of a comparator.

BACKGROUND OF THE INVENTION

An interesting known mathematical problem is presented if one is given 12 items, such as balls, of similar appearance and asked to find which ball is different in weight from the others and whether it is lighter or heavier, utilizing only three weighings on a balance scale. The problem, though solvable, is quite difficult and challenging. I have referred to this problem as "Odd Ball".

OBJECTS OF THE INVENTION

It is an object of the present invention to provide an electronic Odd Ball game in which the 12 balls are represented by single pole double throw switches for selectively applying randomly generated signals indicative of ball weights to different sides of an electronic comparator indicator.

It is a further object of the present invention to provide a technique for randomly generating signals indicative of ball weights in which one signal is different than the others and either greater than or less than the others in magnitude.

SUMMARY OF THE INVENTION

Briefly, the aforementioned and other objects of the present invention are satisfied by providing a plurality of single pole, double throw, center-off switches each representative of a different ball. A random generator means includes a recirculating shift register having a plurality of digital cells each feeding a different one of the wipers of the switches.

An Initialize button is coupled to the input of a one-shot for firing a short pulse to initialize the shift register with a digital one state in one cell and a digital zero state in the other cells. A gating circuit provides an enabling signal after the expiration of the pulse which endures as long as the button is depressed. The enabling signal gates a clock signal to the shift register so that the shift register is clocked a substantially random number of times measured modulo the number of cells therein. As a consequence a digital one signal is applied to a random one of the wipers and a digital zero signal is applied to the other wipers.

For selectively adding the signals in two sets, first and second contacts of the switches respectively feed first and second adding means. Since only one signal is digital 1 and the others are digital zero each of the adding means is mechanized as an OR means as the possible signal sums are only one or zero.

The shift register randomly selects which of the balls is different. For independently randomly selecting whether the different ball is lighter or heavier than the others, a random inverting switch is interposed between the output terminals of the OR means and the input terminals of an indicating comparator for electrical signals such as a voltmeter having a center null needle capable of deflection in either direction. The inverting switch comprises a pair of EXCLUSIVE OR gates each interposed between a different OR means output and a different one of the comparator terminals. One input of each of the EXCLUSIVE OR gates is fed by the output of a divide by 2 means clocked by a signal from another clock source during the duration of the aforementioned enabling signal to provide a random control state so that the inverting means randomly either inverts or doesn't invert the OR means output signals applied thereto for application to the terminals of the camparator.

Other objects, features and advantages of the present invention will become apparent upon perusal of the following detailed description of the preferred embodiment thereof when taken in conjunction with the appended drawing wherein:

FIG. 1 is a pictorial presentation of the game apparatus of the present invention; and FIG. 2 is an electrical schematic for the apparatus of FIG. 1.

DETAILED DESCRIPTION

Figure 1:
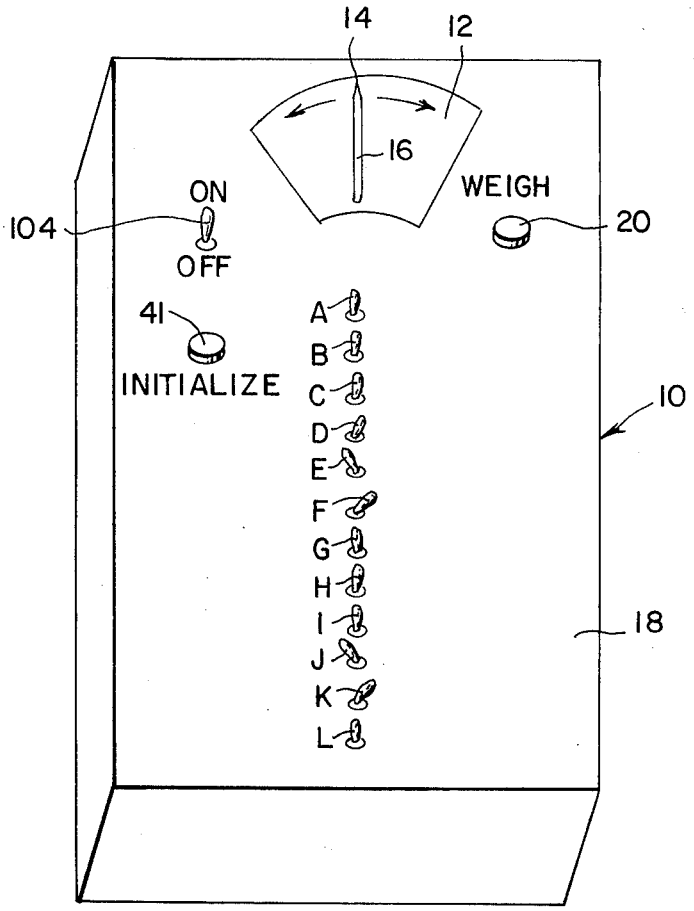
Figure 2:
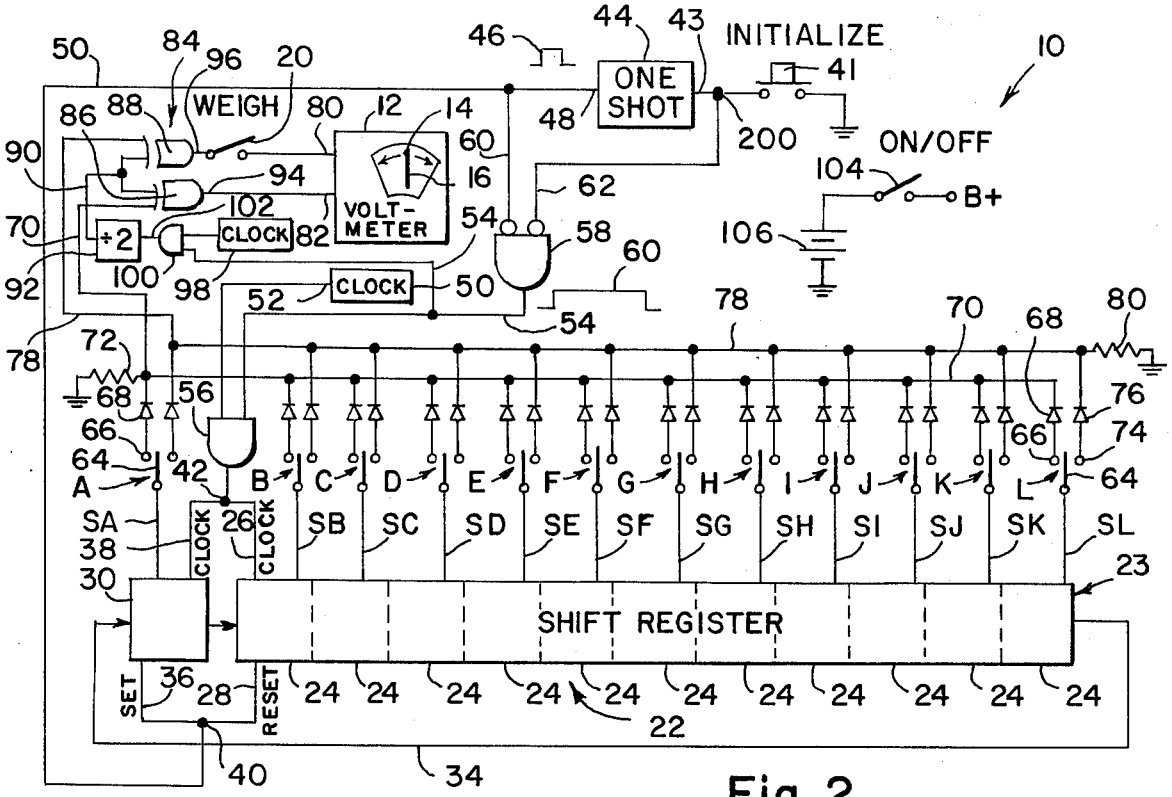

The game of ODD BALL involves the problem of determining which of 12 balls is different in weight from the others and whether it is lighter or heavier utilizing only 3 weighings on a balance scale. Referring to FIGS. 1 and 2 of the drawing, in accordance with the principles of the present invention this problem is mechanized electrically in an ODD Ball Game Apparatus 10 in which the ball weights are formed by randomly generated electrical digital signal outputs SA through SL and selected sums of the signals thereon are compared on an electrical comparator indicator such as a voltmeter 12 having a center null position 14 for its needle 16 which is capable of deflection to either the left or right. The meter 12 represents a balance scale.

Apparatus 10 comprises a housing 18 which carries a linear array of twelve single pole double throw center-off toggle switches labelled A through L respectively representative of the twelve balls. The switches are mounted in line with center position 14 and have an upstanding center-off or neutral position such as illustrated for switches A and B. If a switch is thrown to the left, such as illustrated for E and J, it is intended that this represent placing the balls E and J on the left hand side of the balance represented by meter 12. Similarly if a switch is thrown to the right hand side, such as illustrated for switches H and K, it is intended that the placing the balls H and K on the right hand side of a balance be represented. In response thereto, upon depressing of a normallyopen pushbutton switch 20, labelled "WEIGH", the needle 16 is swung to whichever side has the heavier balls, or if the balls are equal, the needle remains in its center position 14.

The outputs SA through SL are the parallel outputs of a recirculating shift register 22 which includes a string 23 of eleven digital cells 24 having a common reset input 26 and clock input 28. A single similar digital 30 feeds string 23 and receives a feedback input from the last cell 24 of the string via lead 34. Cell 30 feeds one of the outputs, such as SA, and has a set input 36 and a clock input 38 respectively tied to the reset input 28 and clock input 26 of string 23 at nodes 40 and 42. If a digital zero signal is applied to node 40 the recirculating shift register 22 is forced to a digital one state in cell 30 and a digital zero state in cells 24.

A normally open push button switch 41, labelled "Initialize", is interposed between ground (a digital zero signal) and a node 200 which is connected to the input 43 of a one shot 44 for generating a digital one pulse 46 of short duration, such as 10 microseconds, at its output 48 in response to the depression of switch 41. The one-shot output 48 is coupled to node 40 by lead 50 for forcing the shift register to the aforementioned state during the pulse. This serves to initialize the shift register with a digital one state in only one of the cells 24 and 30.

A clock 50, in the megahertz range, is provided for application to the node 42 for clocking shift register 22 to shift this digital one state from cell to cell of the shift register. In order for the cell location of this digital one state to be randomly determined, the clock output 52 is gated by a digital one signal of random duration on line 54. Thus, output 52 and line 54 are applied to the two inputs of an AND gate 56 which in turn feeds node 42.

The line 54 is fed by a NOR gate 58 having two inputs 60 and 62 respectively fed by one shot output 48 and node 200. As should be apparent to those skilled in the digital arts, a relatively long digital one pulse 60 appears on line 54 from the time after one-shot pulse expires till the button 41 is released which is generally on the order of seconds in duration. The number of clock pulses from clock 50 gated through to shift register 22 when measured modulo 12 (the number of cells therein) it will be appreciated comprises an extremely random number and consequently the cell 24 or 30 having the digital one state is randomly determined. Since outputs SA-SL have the same states as their associated cells, the one of outputs SA-SL having a digital one state is also randomly determined.

The wipers 64 of switches A through L are respectively connected to outputs SA through SL. Left contacts 66 of each of the switches A through L are connected to the inputs of an adding means which is conveniently mechanized as OR gate since the signals on any combination of lines SA-SL may total only digital one or digital zero depending upon whether or not the signal having the digital one state is included in the selected combination. This OR gate comprises diodes 68 directed between each left contact 66 and a bus 70 which is grounded via a resistor 72. Similarly, the right contacts 74 of the switches A-L are connected to an OR gate for addition which comprises diodes 76 directed between contacts 76 and a bus 78 which is grounded via a resistor 80. It should be apparent that the buses 70 and 78 contain the sums of the digital signals respectively selected by left and right movement of switches A through L.

The buses 70 and 78 are respectively coupled to the meter terminals 80 and 82 via a random inverting means 84. Since which one of outputs SA through SL has a different signal is determined by shift register 22, the inverting means 84 is provided to randomly determine whether the different signal is greater than or less than the other signals in magnitude. Inverting means 84 comprises a pair of EXCLUSIVE OR gate 86 and 88 which are respectively driven by buses 70 and 78 at one input and are both driven from the output 90 of a divide by two flip flop 92 at their other inputs. It will be appreciated that if output 90 has a digital zero state, the respective outputs 94 and 96 of EXCLUSIVE OR gates 86 and 88 will respectively have the same states as on buses 70 and 78 while if output 90 has a digital one state, outputs 94 and 96 will respectively have the inverse of the states on buses 70 and 78. Output 94 is directly connected to meter terminal 82 while output 96 is connected to meter terminal 80 via switch 20 for activating the meter only when the switch is depressed.

For randomly setting the state of divide by two flip-flop 92, a clock 98 is provided which is asynchronous with clock 50 so that the determination of light or heavy will be independent of the determination of the odd ball. An and gate 100 is interposed between clock 98 and the input 102 to divide by two flip-flop 92. Gate 100 receives the enabling input from output 54 so that clock pulses will be applied to flip-flop 92 during the duration of the pulse 60 for rapidly alternating its state.

In the use of apparatus 10, an on-off switch 104 is turned on to couple a battery 106 within housing 18 to the circuitry therein. Then Initialize button 41 is depressed for a few seconds to randomly present an Odd Ball problem.

Switches A through L are utilized to select which balls are to be placed on the balance represented by the indicating needle 16 and which side of the balance the selected balls are to be placed.

In the proper solution of the Odd Ball problem, initially four balls should be weighed against four balls. If there is a balance, the eight used are equal and three of the four remaining are weighed against three determined as equal. If there is a balance the unweighed ball is odd and only an additional weighing is required to determine whether it is heavier or lighter. If there is not a balance it is determined whether the odd ball is heavier or lighter and in a third weighing two of the three are compared to enable sorting out the odd ball utilizing this knowledge of heavier or lighter.

If in the initial weighing there was an unbalance, the eight weighed are segregated into four candidates for heavier and four candidates for lighter. Then combinations of two of the heavier candidates and one of the lighter candidates are placed on opposite sides of the balance. If these groupings balance, two lighter candidates remain from which the odd ball can be sorted out in one weighing against each other or against one formally determined as not odd.

In the event of imbalance, the two heavy candidates on the heavy side and the one lighter candidate on the light side are noted. Then by weighing one of these noted heavier candidates against the other, the odd ball can be determined.

Having described the preferred embodiment of the present invention in specific detail it should be noted that numerous modifications, additions and omissions in the details thereof are possible within the intended spirit and scope of the invention claimed herein.

What is claimed is:

1. A game apparatus determining which one of plural items is different comprising: a plurality of single pole, double throw, center-off switches respectively representative of each of said items; each of said switches having a wiper associated with first and second contacts; random generator means coupled to said wipers for placing a first electrical signal on a random one of said wipers and a second electrical signal on each of the other wipers; electrical comparator means having two input terminals for receiving two input signals; said comparator means being configured for indicating whether said input signals are equal, and if not equal which is the greater in magnitude; first and second adder means respectively fed by each of said first and second contacts, each of said adder means having an output terminal; and means for coupling the output terminal of one of said adder means to one of said input terminals and for coupling the output of the other of said adder means to the other of said input terminals.

2. The apparatus of claim 1 wherein said random generator means comprises a recirculating shift register having a plurality of cells, each of said cells driving a different one of said wipers; means for initializing said shift register with a digital one state in only one of said cells; and means for clocking said shift register for a random period of time.

3. The apparatus of claim 2 wherein said first and second adder means comprise OR means.

4. The apparatus of claim 3 wherein said coupling means comprises a random inverting means interposed between said adder output terminals and said comparator input terminals.

* * * * *